US010139774B2

(12) United States Patent
Abe et al.

(10) Patent No.: US 10,139,774 B2
(45) Date of Patent: Nov. 27, 2018

(54) DEVELOPING DEVICE AND IMAGE FORMING APPARATUS

(71) Applicant: CANON KABUSHIKI KAISHA, Tokyo (JP)

(72) Inventors: Tsukasa Abe, Yokohama (JP); Masato Tanabe, Susono (JP); Osamu Anan, Susono (JP); Teruhiko Sasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/494,376

(22) Filed: Apr. 21, 2017

(65) Prior Publication Data

US 2017/0315498 A1 Nov. 2, 2017

(30) Foreign Application Priority Data

Apr. 27, 2016 (JP) ..... 2016-089066
Feb. 27, 2017 (JP) ..... 2017-034505

(51) Int. Cl.
*G03G 21/16* (2006.01)
*G03G 15/08* (2006.01)
*G03G 21/18* (2006.01)

(52) U.S. Cl.
CPC ..... *G03G 21/1647* (2013.01); *G03G 15/0875* (2013.01); *G03G 21/1671* (2013.01);
(Continued)

(58) Field of Classification Search
CPC ..... G03G 21/16; G03G 21/1642; G03G 21/1647; G03G 21/1676; G03G 21/1814;
(Continued)

(56) References Cited

U.S. PATENT DOCUMENTS

2009/0317133 A1 12/2009 Nishimura
2010/0142994 A1* 6/2010 Kinoshita ..... G03G 21/1842 399/111

(Continued)

FOREIGN PATENT DOCUMENTS

EP 2333615 A1 6/2011
JP H06348123 A 12/1994

(Continued)

*Primary Examiner* — Benjamin Schmitt
(74) *Attorney, Agent, or Firm* — Canon U.S.A., Inc. IP Division

(57) ABSTRACT

An image forming apparatus includes a first pressing member configured to press a unit that has a second rotating member that can come into contact with a first rotating member, and a supporting member rotatably supporting the second rotating member. The first pressing member moves the supporting member so that the second rotating member moves from the contact position to the separated position. Also provided is a second pressing member that presses the supporting member. The second pressing member is capable of moving between a mounting/detaching restriction position where mounting/detaching of the cartridge to/from the apparatus main body is restricted, and a mounting/detaching allowing position where mounting/detaching of the cartridge to/from the apparatus main body is allowed. The second pressing member moves the unit to a position distanced from the first rotating member by moving from the mounting/detaching restriction position to the mounting/detaching allowing position while pressing the supporting member.

15 Claims, 9 Drawing Sheets

(52) U.S. Cl.
CPC ..... *G03G 21/1676* (2013.01); *G03G 21/185* (2013.01); *G03G 2215/068* (2013.01)

(58) Field of Classification Search
CPC ..... G03G 21/1817; G03G 21/1821; G03G 21/1825; G03G 21/1839; G03G 21/1842; G03G 2221/16; G03G 2221/163; G03G 2221/1651; G03G 2221/1654; G03G 2221/1853; G03G 2221/1861
USPC ..... 399/107, 110, 111, 113, 119
See application file for complete search history.

(56) References Cited

U.S. PATENT DOCUMENTS

| | | | | |
|---|---|---|---|---|
| 2012/0321342 | A1 | 12/2012 | Mori | |
| 2015/0055979 | A1* | 2/2015 | Igarashi ..... | G03G 21/1604 399/119 |
| 2015/0227110 | A1 | 8/2015 | Yoshimura | |

FOREIGN PATENT DOCUMENTS

| | | | |
|---|---|---|---|
| JP | 2006267602 | A | 10/2006 |
| JP | 2009139518 | A | 6/2009 |
| JP | 2012063391 | A | 3/2012 |
| JP | 5067913 | B2 | 11/2012 |
| JP | 2013182036 | A | 9/2013 |
| JP | 2014059586 | A | 4/2014 |

* cited by examiner

DEVELOPING DEVICE AND IMAGE FORMING APPARATUS

BACKGROUND OF THE INVENTION

Field of the Invention

The present invention relates to an image forming apparatus using an electrophotographic image forming system (electrophotographic process), and a developing device used in the image forming apparatus.

An image forming apparatus as referred to here forms images on a recording material (recording medium) using an electrophotographic image forming process, for example. Examples of image forming apparatuses include printers (laser beam printers, LED printers, etc.), copiers, facsimile devices, word processors, and multifunction peripherals (multifunction printers) thereof.

A developing device is a device that develops an electrostatic latent image formed on a photosensitive drum (photosensitive member) serving as an image bearing member using a developer. The developing device is made up of a developing unit and a developing frame that supports the developing unit, and parts and the like relating to the developing unit. Examples of the developing unit include a developing roller serving as a developer bearing member, a developing blade serving as a developer regulating member, and so forth.

Description of the Related Art

In an image forming apparatus such as a printer or the like that uses the electrophotographic process, image recording is performed as follows. A photosensitive member is uniformly charged, and next, an electrostatic image is formed on the photosensitive member by selectively exposing the charged photosensitive member. The electrostatic image formed on the photosensitive member is then visualized by toner, which is a developer, to form a toner image. The toner image formed on the photosensitive member is finally transferred onto a recording material such as a recording sheet, plastic sheet, or the like, and the toner image is fixed onto the recording material by heat and pressure being applied thereto.

An image forming apparatus using such an electrophotographic process generally requires maintenance of various types of process units used in the electrophotographic process. Examples of process units include a charging unit, developing unit, and cleaning unit, and so forth, which act upon the photosensitive drum. A method has been put into practical use where the photosensitive member, charging unit, developing unit, cleaning unit, and so forth, are collectively formed into a cartridge that is detachable from the main body of the image forming apparatus. This cartridge method enables an image forming apparatus that has excellent usability to be provided. There also are known configurations of cartridges such as a drum cartridge having the photosensitive drum, a developing cartridge that serves as a developing device having a developing unit (e.g., developing roller), a toner cartridge that supplies developer, and so forth.

Japanese Patent No. 5067913 proposes a method of attaching and detaching the cartridges from to and from apparatus main body in the axial direction of the photosensitive drum. The cartridge mounted to the apparatus main body moves upwards which is the vertical direction, and the cartridge is positioned by a regulated portion provided to the cartridge coming into contact with a regulating portion provided to the apparatus main body.

However, the process cartridge described in Japanese Patent No. 5067913 has the drum cartridge and developing cartridge integrated, so when lifetime of the developing cartridge ends, the drum cartridge is also replaced at the same time. This restricts to what extent running costs can be reduced. Accordingly, a configuration is desired where the drum cartridge and developing cartridge can be attached and detached to and from the image forming apparatus.

There is the need to suppress the developing roller and photosensitive drum from sliding over each other during the actions of attaching and detaching the developing cartridge to and from the apparatus main body. Accordingly, the developing cartridge is configured so as to be movable between a position where the developing roller and photosensitive drum come into contact, and a position where the developing roller and photosensitive drum are separated.

An image forming apparatus configured so that the developing cartridge is movable in this way has in the main body (copier main body), for example, a guide rail that is movable as to the apparatus main body, and a photosensitive belt. The developing cartridge is mounted to the apparatus main body, guided by the guide rail, and the guide rail is moved in a state where the developing cartridge is mounted to the apparatus main body. Thus, an electrophotographic copier, where the developing roller and photosensitive belt are movable between a position of coming into contact, and a position of being separated, is proposed in Japanese Patent Laid-Open No. 6-348123.

However, in the apparatus disclosed in Japanese Patent Laid-Open No. 6-348123, the developing cartridge is mounted/detached to/from the apparatus main body being guided by the guide rail that is movable as to the apparatus main body, so there are cases where the position of mounting/dismounting the developing cartridge to/from the apparatus main body is unstable. Accordingly, there may be interference between the developing roller and photosensitive drum when mounting/dismounting the developing cartridge to/from the apparatus main body, which may damage these members.

On the other hand, securing sufficient clearance between the developing roller and photosensitive drum when mounting/dismounting the developing cartridge to/from the apparatus main body enables interference between the developing roller and photosensitive drum to be suppressed. However, this requires securing sufficiently great space for the guide rail that is movable as to the apparatus main body to move, so the size of the apparatus increases accordingly.

SUMMARY OF THE INVENTION

It has been found desirable to provide an image forming apparatus and cartridge, where interference between a developer bearing member (second rotating member) that the image forming apparatus has and an image bearing member (first rotating member) can be suppressed, when attaching/detaching a first cartridge that has the image bearing member to/from the image forming apparatus.

An image forming apparatus according to the present disclosure includes: an apparatus main body to which a cartridge that has a first rotating member is detachably mountable; a first pressing member configured to press a unit that has a second rotating member that can come into contact with the first rotating member, and a supporting member rotatably supporting the second rotating member. The first pressing member moves the second rotating member from a contact position where the second rotating member is in contact with the first rotating member to a separated position where the second rotating member is separated from the first rotating member, by moving while pressing the supporting member. The image forming apparatus further includes a second pressing member configured to press the supporting member. The second pressing member is capable of moving between a mounting/detaching restriction position where mounting/detaching of the cartridge to the apparatus main body is restricted, and a mounting/detaching allowing position where mounting/detaching of the cartridge to the apparatus main body is allowed. The second pressing member moves the unit to a position distanced from the first rotating member by moving from the mounting/detaching restriction position to the mounting/detaching allowing position while pressing the supporting member, so the cartridge is in an extractable state from the apparatus main body.

Further features of the present invention will become apparent from the following description of exemplary embodiments with reference to the attached drawings.

DESCRIPTION OF THE EMBODIMENTS

A preferred embodiment of the present invention will be described in detail with reference to the attached drawings.

First Embodiment

Image Forming Apparatus

Figure 2:
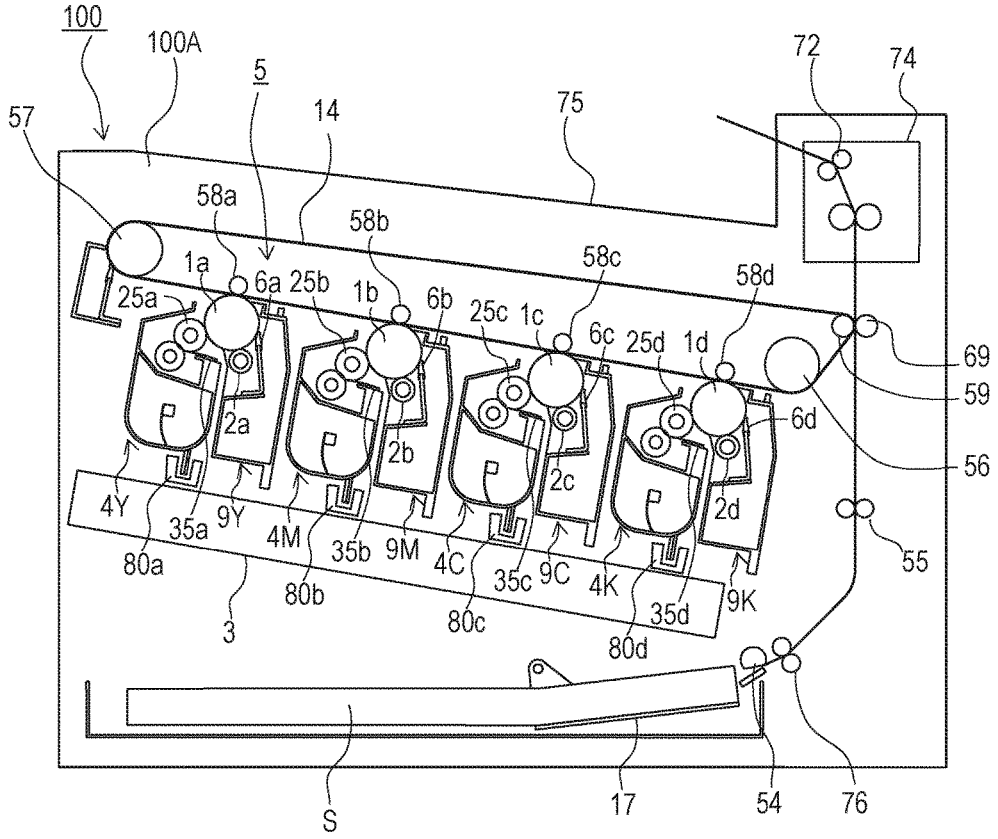
FIG. 2 is a schematic diagram of an image forming apparatus to which is mounted a developing device according to an embodiment of the present invention and a drum cartridge facing the same.

The overall configuration of an image forming apparatus 100 to which is mounted a developing cartridge serving as a developing device according to the embodiment of the present invention, and a drum cartridge facing the developing cartridge, will be described with reference to FIG. 2. As illustrated in FIG. 2, mounted to the apparatus main body 100A are four detachably mountable photosensitive drum cartridges (or simply "drum cartridges") 9 (9Y, 9M, 9C, 9K) that have photosensitive drums 1 (1*a*, 1*b*, 1*c*, 1*d*) serving as image bearing members. Also mounted to the apparatus main body 100A are four developing devices (developing cartridges) 4 (4Y, 4M, 4C, 4K).

These photosensitive drum cartridges 9 serving as first cartridges, and the developing cartridges 4 serving as second cartridges, are each independently detachably mounted to the apparatus main body 100A by mounting members omitted from illustration. Note that the photosensitive drum cartridges 9 and developing cartridges 4 are disposed in parallel to each other, in a state inclined as to the level direction within the apparatus main body 100A.

Each photosensitive drum cartridge 9 has process units, such as a charging roller 2 (2*a*, 2*b*, 2*c*, 2*d*) serving as a charging member, a cleaning member 6 (6*a*, 6*b*, 6*c*, 6*d*) serving as a cleaning member, and so forth, integrally disposed in the periphery of the photosensitive drum (first rotating member) 1. Each developing cartridge 4 (4Y, 4M, 4C, 4K) also has a developing roller (second rotating member) 25 (25*a*, 25*b*, 25*c*, 25*d*) serving as a developer bearing member. Process units, such as a developing blade 35 (35*a*, 35*b*, 35*c*, 35*d*) serving as a developer regulating member, and so forth, are integrally disposed thereat.

Note that in the following description, members of which there are a plurality may be referred to individually in single form, collectively in single form, or as a plurality, depending on context.

The charging roller 2 is for uniformly charging the surface of the photosensitive drum 1. The developing roller 25 is for coming into contact with the photosensitive drum 1 and forming a visible image by developing a latent image formed on the photosensitive drum 1 by a developer (toner). The cleaning member 6 is for removing residual toner on the photosensitive drum 1 after the toner image formed on the photosensitive drum 1 has been transferred to a recording medium (recording material) S.

A scanner cartridge 3 is disposed below the photosensitive drum cartridge 9 and developing cartridge 4. The scanner cartridge 3 performs selective exposure of the photosensitive drum 1 based on image information, thereby forming a latent image on the photosensitive drum 1.

A cassette 17 storing the recording medium S is mounted at the lower portion of the apparatus main body 100A. A conveying unit is provided to convey the recording medium S, so as to pass over a secondary transfer roller 69 and fixing unit 74 and to be conveyed to the upper portion of the apparatus main body 100A. More specifically, a sheet feed roller 54 that separates and feeds the recording medium S within the cassette 17 one sheet at a time, a conveyance roller pair 76 that conveys the recording medium S fed thereto, and a registration roller pair 55 for synchronizing the latent image formed on the photosensitive drum 1 and the recording medium S, are provided.

Further, an intermediate transfer cartridge 5, serving as an intermediate transfer unit to transfer toner images formed on the photosensitive drums 1 (1*a*, 1*b*, 1*c*, 1*d*) is disposed above the photosensitive drum cartridges 9 and developing cartridges 4. The intermediate transfer cartridge 5 has primary transfer rollers 58 (58*a*, 58*b*, 58*c*, 58*d*) at positions facing the photosensitive drums 1 of each color, and a facing roller 59 at a position facing the secondary transfer roller 69. A transfer belt 14 runs over the primary transfer rollers 58 and facing roller 59.

The transfer belt 14 moves cyclically facing and coming into contact with all photosensitive drums 1. Primary transfer from the photosensitive drums 1 to the transfer belt 14 is performed by applying voltage to the primary transfer rollers 58 (58*a*, 58*b*, 58*c*, 58*d*). Applying voltage to the facing roller 59 and disposed on the inner side of the course of the transfer belt 14, and the secondary transfer roller 69, transfers the toner on the transfer belt 14 onto the recording medium S.

When forming an image, each photosensitive drum 1 is rotated, and the photosensitive drums 1 uniformly charged by the charging rollers 2 are selectively exposed by the scanner cartridges 3. Thus, electrostatic latent images are formed on the photosensitive drums 1. The latent images are then developed by the developing rollers 25. This forms toner images of the respective colors on the respective photosensitive drums 1. The toner images on the photosensitive drums 1 are then overlaid on the transfer belt 14 by primary transfer. Synchronously with this image formation, the registration roller pair 55 conveys the recording medium S to a secondary transfer position where the facing roller 59 and the secondary transfer roller 69 are in contact across the transfer belt 14.

Secondary transfer of the toner images on the transfer belt 14 onto the recording medium S is performed by applying transfer bias voltage to the secondary transfer roller 69. This forms a color image on the recording medium S. The recording medium S on which the color image has been formed is heated and pressurized by the fixing unit 74, thereby fixing the toner image. Thereafter, the recording medium S is discharged to a discharge unit 75 by a discharge roller pair 72. Note that the fixing unit 74 is disposed at the upper portion of the apparatus main body 100A.

A cartridge biasing member (or simply "biasing member") 80 (80*a*, 80*b*, 80*c*, 80*d*), to cause the developing roller 25, held in the developing cartridge 4, to come into contact with the photosensitive drum 1, is provided below each developing cartridge 4.

Drum Cartridge

Figure 3:
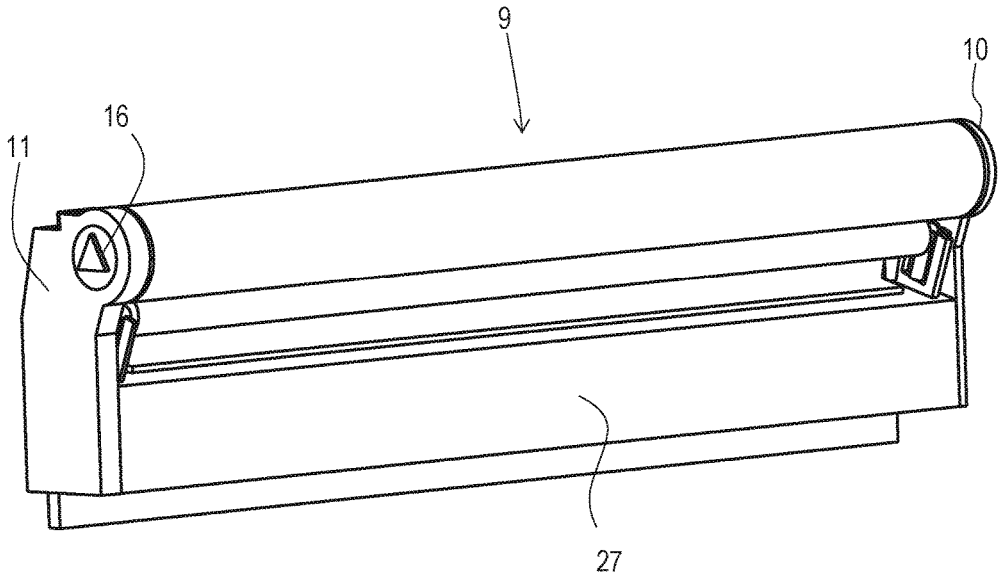
FIG. 3 is an explanatory diagram of a drum cartridge in an image forming apparatus according to an embodiment of the present invention.

Next, the photosensitive drum cartridge 9 according to the present embodiment will be described with reference to FIGS. 3 and 4. FIG. 3 is a configuration diagram of the photosensitive drum cartridge 9 (9Y, 9M, 9C, 9K). Note that the photosensitive drum cartridges 9Y, 9M, 9C, and 9K are all of the same configuration. In a later-described insertion direction of the photosensitive drum cartridges 9 and developing cartridges 4 according to the present embodiment, the upstream side in the insertion direction is defined as the front side, and the downstream side as the rear side.

In FIG. 3, the photosensitive drum 1 is rotatably disposed on a cleaning frame 27 of the photosensitive drum cartridge 9 (9Y, 9M, 9C, 9K), by a drum front-side bearing 10 and a drum rear-side bearing 11. A drum coupling 16 and flange are provided on one side in the axial direction of the photosensitive drum 1.

Figure 4:
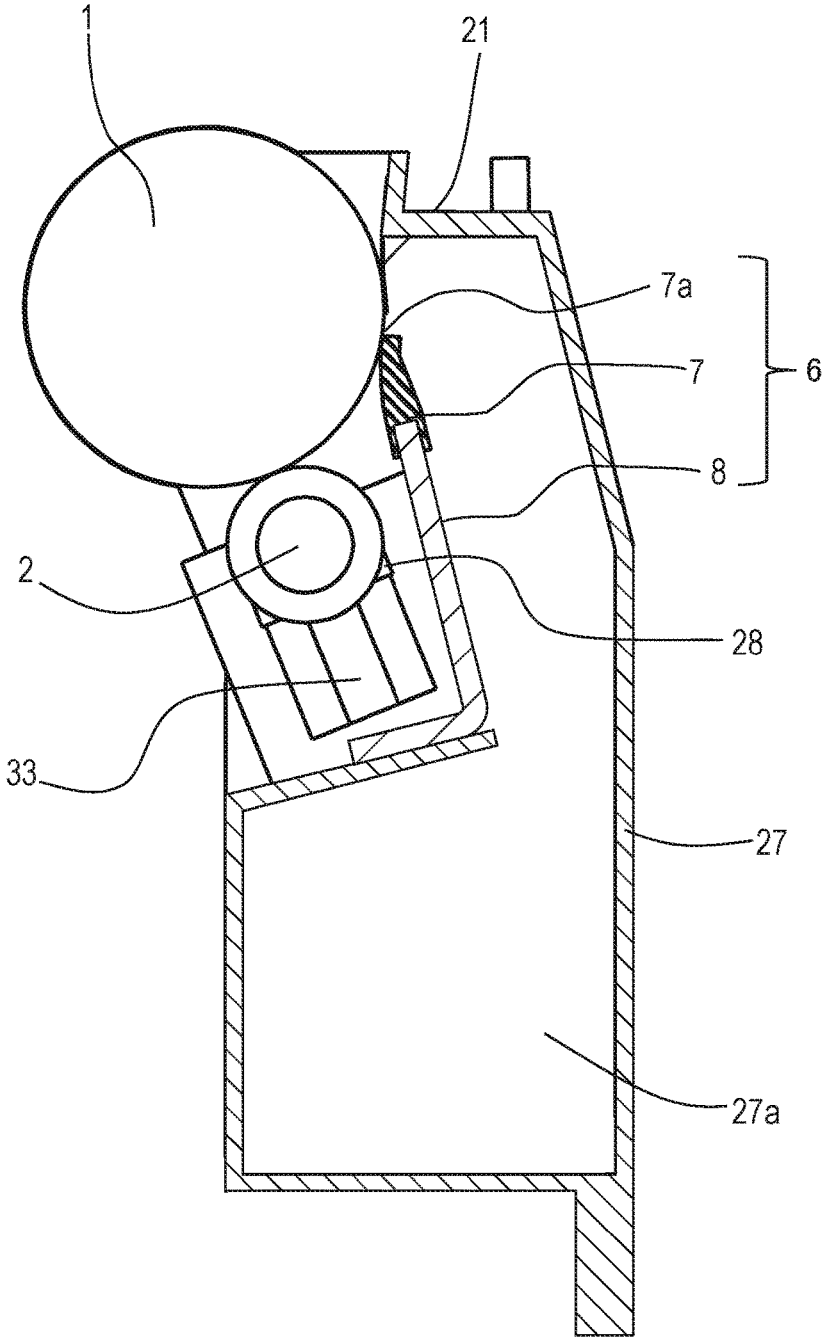
FIG. 4 is principal section of a drum cartridge in an image forming apparatus according to an embodiment of the present invention.

FIG. 4 is a cross-sectional view of the photosensitive drum cartridge 9. The charging roller 2 and cleaning member 6 are disposed in the periphery of the photosensitive drum 1, as described earlier. The cleaning member 6 includes a rubber blade 7 and cleaning support member 8. A tip portion 7*a* of the rubber blade 7 is disposed to come into contact with the photosensitive drum 1 in a direction countering the direction of rotation of the photosensitive drum 1. Residual toner removed from the surface of the photosensitive drum 1 by the cleaning member 6 falls into a waste toner chamber 27*a*. A seal sheet 21 that prevents waste toner in the waste toner chamber 27*a* from leaking comes into contact with the photosensitive drum 1.

The photosensitive drum 1 is rotationally driven in accordance with image forming operations of the photosensitive drum 1, by transmitting driving force of a main body driving motor (omitted from illustration), that is a drive source, to the drum coupling 16 of the photosensitive drum cartridge 9. The charging roller 2 is rotatably attached to the photosensitive drum cartridge 9 via a charge roller bearing 28, pressed toward the photosensitive drum 1 by a pressing member 33 (FIG. 4), and rotates following rotation of the photosensitive drum 1.

Developing Cartridge

Figure 5:
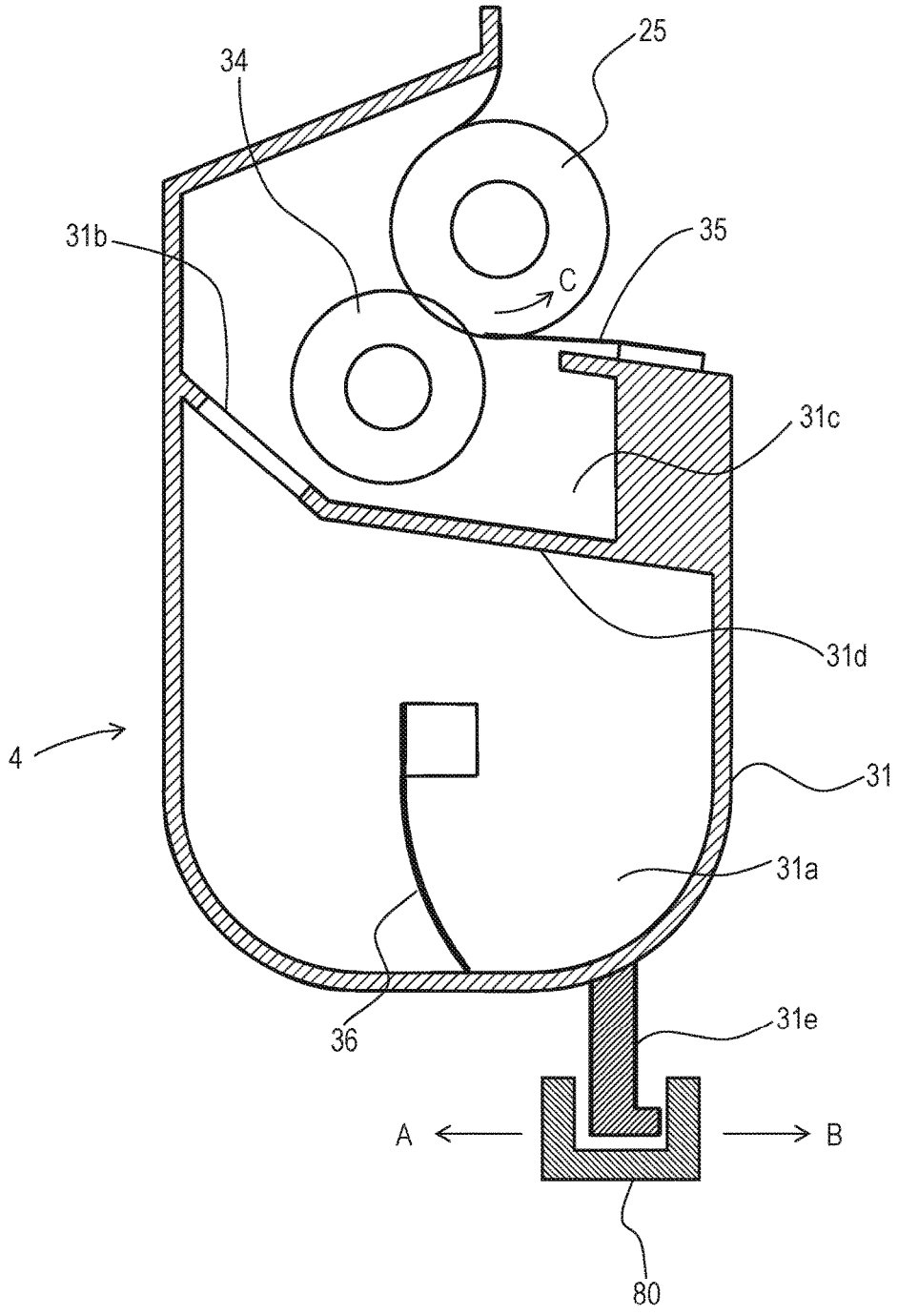
FIG. 5 is principal section of a developing device according to an embodiment of the present invention.

Next, the developing cartridge 4 serving as a developing device according to the embodiment of the present invention will be described with reference to FIGS. 5 through 7. FIG. 5 is a principal section of the developing cartridge 4 (4Y, 4M, 4C, 4K) storing toner in the developing cartridge. The developing cartridge 4Y storing yellow-colored toner, the developing cartridge 4M storing magenta-colored toner, the developing cartridge 4C storing cyan-colored toner, and the developing cartridge 4K storing black-colored toner, are all of the same configuration.

The developing cartridge 4 has a later-described developing unit 39 including a developing roller 25 and a developing frame 31 (second frame). The developing frame 31 rotatably supports the developing roller 25 that comes into contact with the photosensitive drum 1 and rotates in the direction of the arrow C. The developing unit 39 further is provided with a toner supplying roller 34 that comes into contact with the developing roller 25 and rotates, and the developing blade 35 that regulates the toner layer on the developing roller 25.

The developing frame 31 is made up of a developing chamber 31*c* where the developing roller 25 is disposed, and a toner storage chamber 31*a* provided below the developing chamber 31*c*. The developing chamber 31*c* and toner storage chamber 31*a* are partitioned by a partition 31*d*. An opening 31*b* is provided in the partition 31*d*, through which toner passes as it is being conveyed from the toner storage chamber 31*a* to the developing chamber 31*c*. The developing frame 31 further has a biased member 31*e* that is biased by the cartridge biasing member 80 provided to the apparatus main body 100A. A toner conveyance member 36 that stirs the toner stored in the toner storage chamber 31*a*, and also conveys toner to the developing chamber 31*c* via the opening 31*b*, is provided to the toner storage chamber 31*a* of the developing frame 31.

Figure 6:
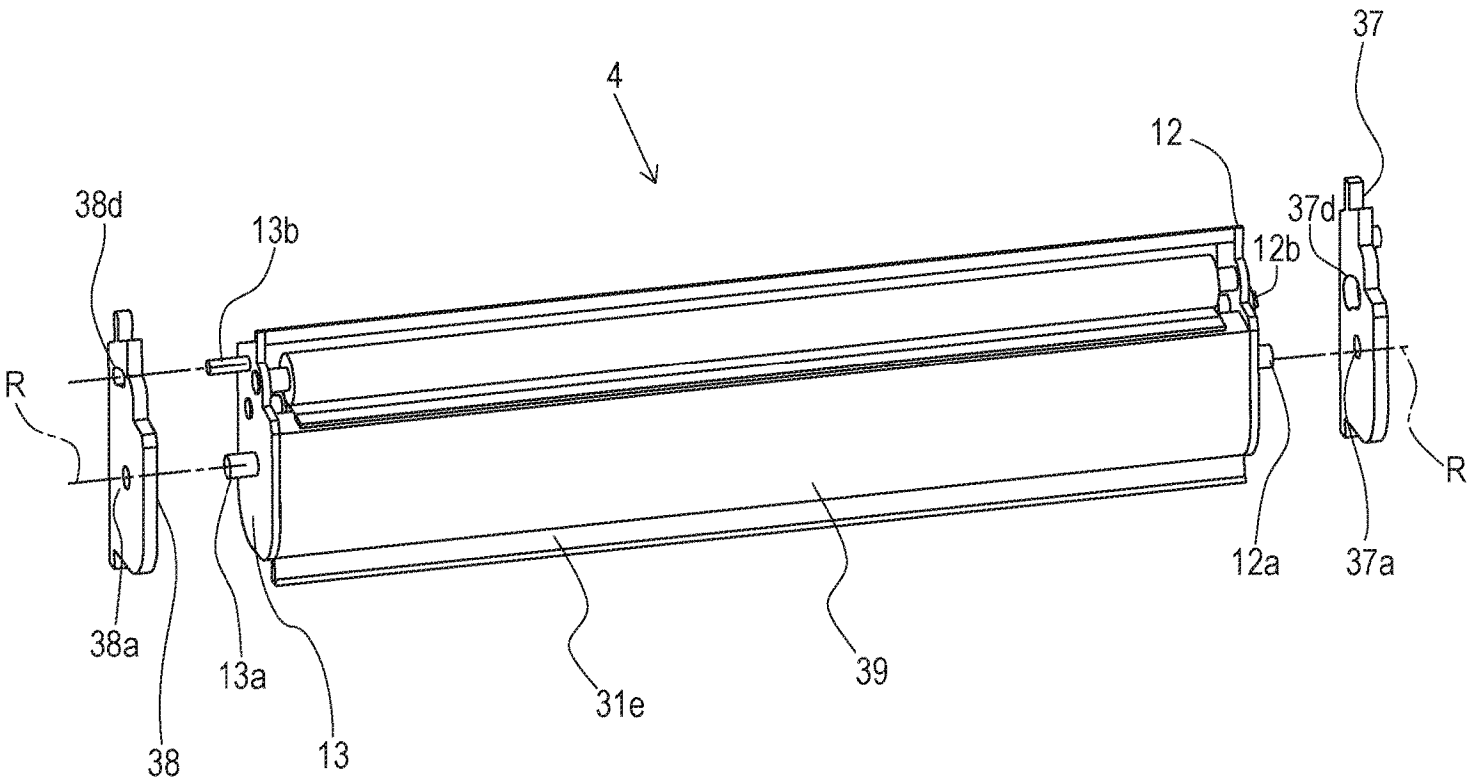
FIG. 6 an explanatory diagram describing the configuration of a developing device according to an embodiment of the present invention.
Figure 7:
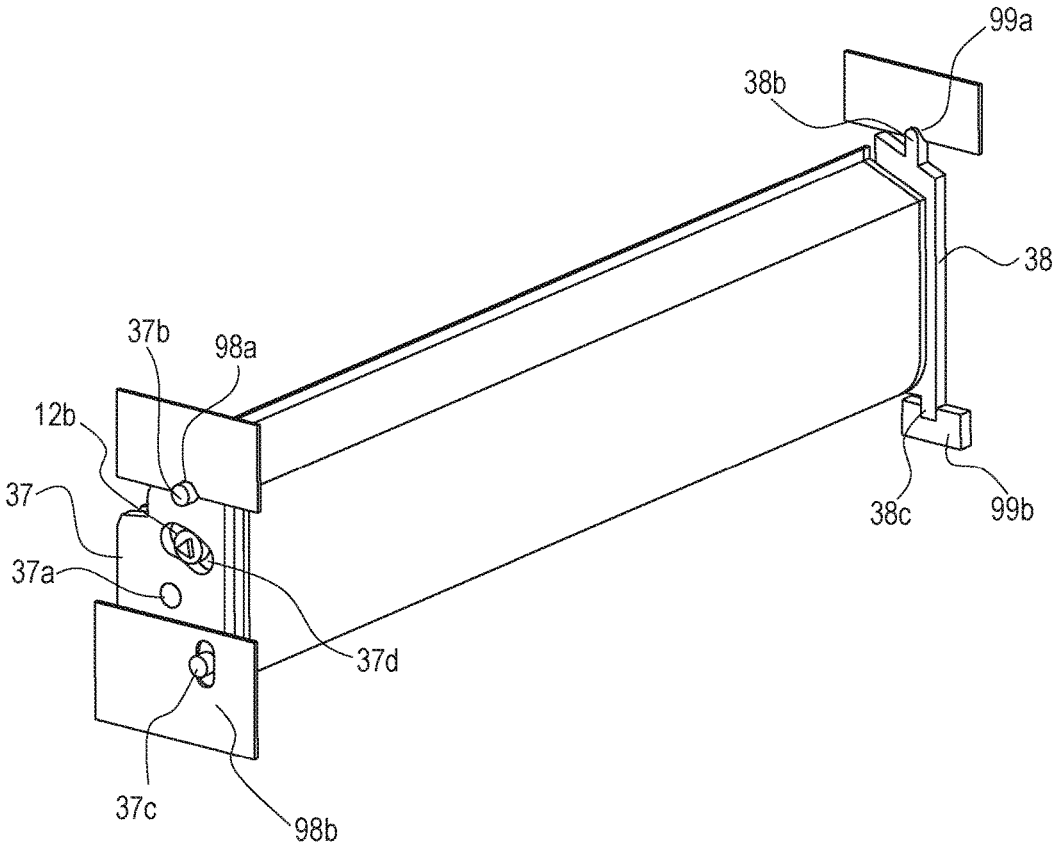
FIG. 7 an explanatory diagram illustrating a state in which a developing device according to an embodiment of the present invention is positioned in a main body of an image forming apparatus.

The developing roller 25 and toner supplying roller 34 illustrated in FIG. 5 are rotatably supported by the developing frame 31, by a developing rear bearing 12 and a developing front bearing 13, disposed at respective sides in the axial direction of the developing roller 25, as illustrated in FIG. 6. The developing unit 39 further is provided with a one-end supporting member (first frame member) 38 at one end side in the axial direction of the developing roller 25, and an other-end supporting member 37 at the other end side in the axial direction of the developing roller 25, as illustrated in FIG. 6.

A first rotational center 37*a* that serves as a positioning hole, pivotably supporting the developing unit 39 and restricting the position of the developing unit 39 in a direction orthogonal to the axial line of the developing roller 25, is provided to the other-end supporting member 37. A second rotational center 38*a* that pivotably supports the developing unit 39 is provided to the one-end supporting member 38.

A boss 13*a* serving as a supporting shaft, pivotably supported by the second rotational center 38*a*, is provided to the developing unit 39. On the other hand, a boss 12*a*, serving as a supporting shaft, pivotably supported by the second rotational center 38*a*, is provided to the first rotational center 37*a*, at the other end side in the axial direction of the developing roller 25 as to the boss 13*a* of the developing unit 39. The bosses 12*a* and 13*a* are cylindrical in shape. The developing unit 39 also is provided with a coupling 12*b* serving as a driving force receiving unit, that receives rotational driving force to rotate the developing roller 25, as illustrated in FIGS. 6 and 7. A hole 37*d* is provided in the other-end supporting member 37 to avoid interference with the coupling 12*b*, such that the coupling 12*b* is accommodated within the hole 37*d*.

The one-end supporting member 38 and other-end supporting member 37 can pivot with regard to the developing unit 39, on the bosses 13*a* and 12*a* pivotably supported by the second rotational center 38*a* and first rotational center 37*a*. That is to say, the rotational axis of the one-end supporting member 38 and other-end supporting member 37 as to the developing unit 39 matches a center axis line R of the bosses 13*a* and 12*a*. Further, the one-end supporting member 38 and other-end supporting member 37 are each capable of independently moving as to the developing unit 39.

Figure 1:
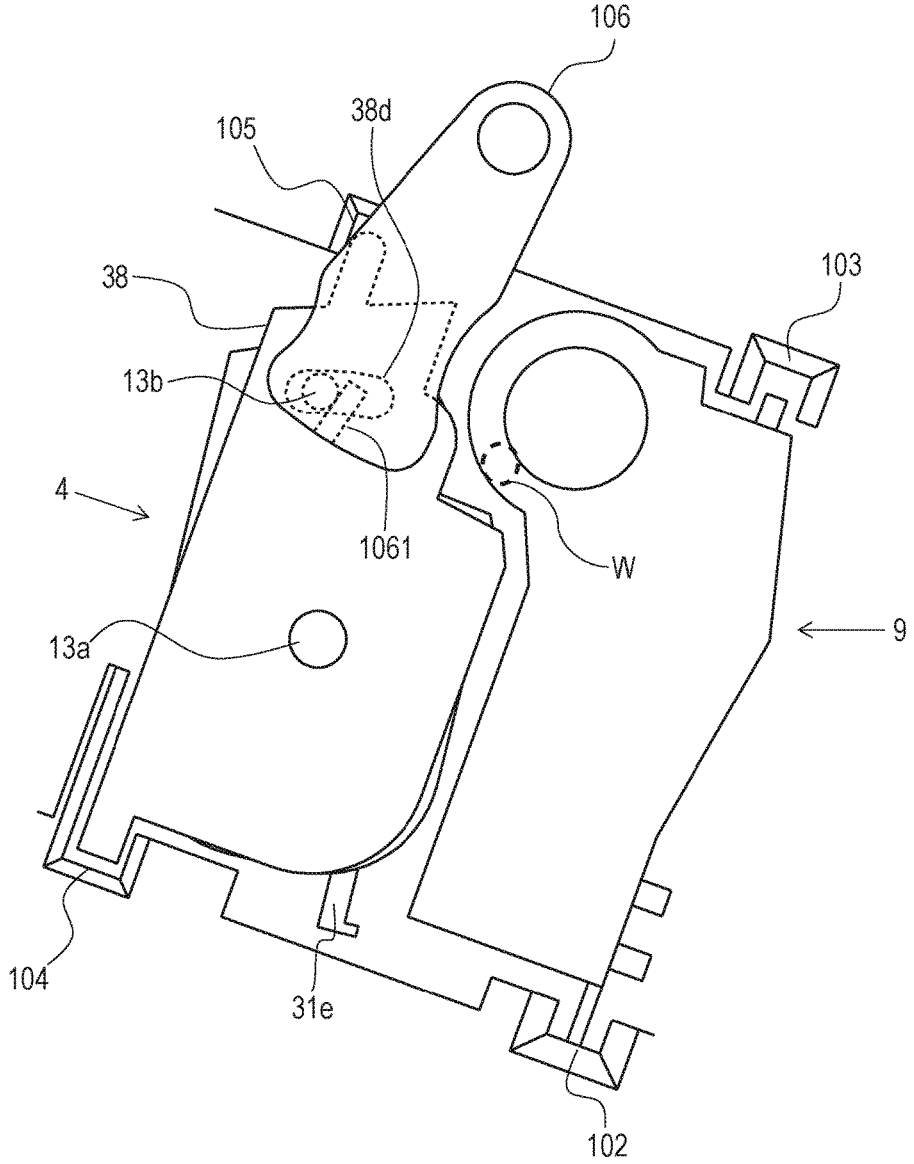
FIG. 1 is a mounting configuration diagram of a drum cartridge facing a developing device according to an embodiment of the present invention.

The developing unit 39 further has a biased member (pressed member) 13*b*, and a hole (hole portion) 38*d* is formed in the one-end supporting member 38 so that there is no interference between the biased member 13*b* and the one-end supporting member 38. The biased member 13*b* is a projection protruding in the direction of the rotational axis (center axis line R) of the second rotational center 38*a*. Note that the center axis line R is parallel to the rotational axis direction of the developing roller 25 (the longitudinal direction of the developing roller 25). The biased member 13*b* basses through the hole 38*d*, so as to be capable of coming into contact with a later-described pressing portion 1061. FIG. 1 is a diagram illustrating the developing unit 39 mounted to the apparatus main body 100A from the rotational axis direction (center axis line R), with the biased member 13*b* being disposed on the opposite side of the boss 13*a* from the biased member 31*e*.

Next, a first engaged portion 37*b* and a first rotation stopper 37*c* are provided to the other-end supporting member 37. The first engaged portion 37*b* and rotation stopper 37*c* respectively engage a first engaging portion 98*a* and a first rotation stopping portion 98*b* provided to the apparatus main body 100A, after insertion into the apparatus main body 100A. Thus, the other-end supporting member 37 is positioned in the apparatus main body 100A.

Further, a second engaged portion 38*b* and a second rotation stopper 38*c* are provided to the one-end supporting member 38. The second engaged portion 38*b* and second rotation stopper 38*c* respectively engage a second engaging portion 99*a* and a second rotation stopping portion 99*b* provided to the apparatus main body 100A, after insertion into the apparatus main body 100A. Thus, the one-end supporting member 38 is positioned in the apparatus main body 100A.

In a state where the other-end supporting member 37 and one-end supporting member 38 are each positioned to the apparatus main body 100A, the bosses 12*a* and 13*a* together make up a pivoting center of the developing unit 39. According to this configuration, when performing image forming, the biased member 31*e* of the developing frame 31 (FIG. 5) is biased in a contact direction A illustrated in FIG. 5 by the biasing member 80, so the developing roller 25 comes into contact with the photosensitive drum 1. That is to say, the developing roller 25 is at a contact position in contact with the photosensitive drum 1. When image forming is not being performed, the biased member 31*e* of the developing frame 31 (FIG. 5) is biased in a separating direction B illustrated in FIG. 5 by the biasing member 80, so the developing roller 25 moves away from the photosensitive drum 1. Thus, the developing roller 25 is at a first separated position away from the photosensitive drum 1. The biasing member 80 is movable in the contact direction A and the separating direction B, being driven by a motor (drive source) omitted from illustration, that is provided to the apparatus main body 100A.

Configuration Whereby Drum Cartridge and Developing Cartridge are Inserted into Apparatus Main Body Next, the configuration whereby the photosensitive drum cartridges 9 and developing cartridges 4 are inserted into the apparatus main body 100A will be described with reference to FIGS. 1, 8, and 9. The apparatus main body 100A is provided with mounting opening portions 101 (101*a*, 101*b*, 101*c*, 101*d*) to which the photosensitive drum cartridges 9 and developing cartridges 4 are mounted, as illustrated in FIG. 8.

Figure 9:
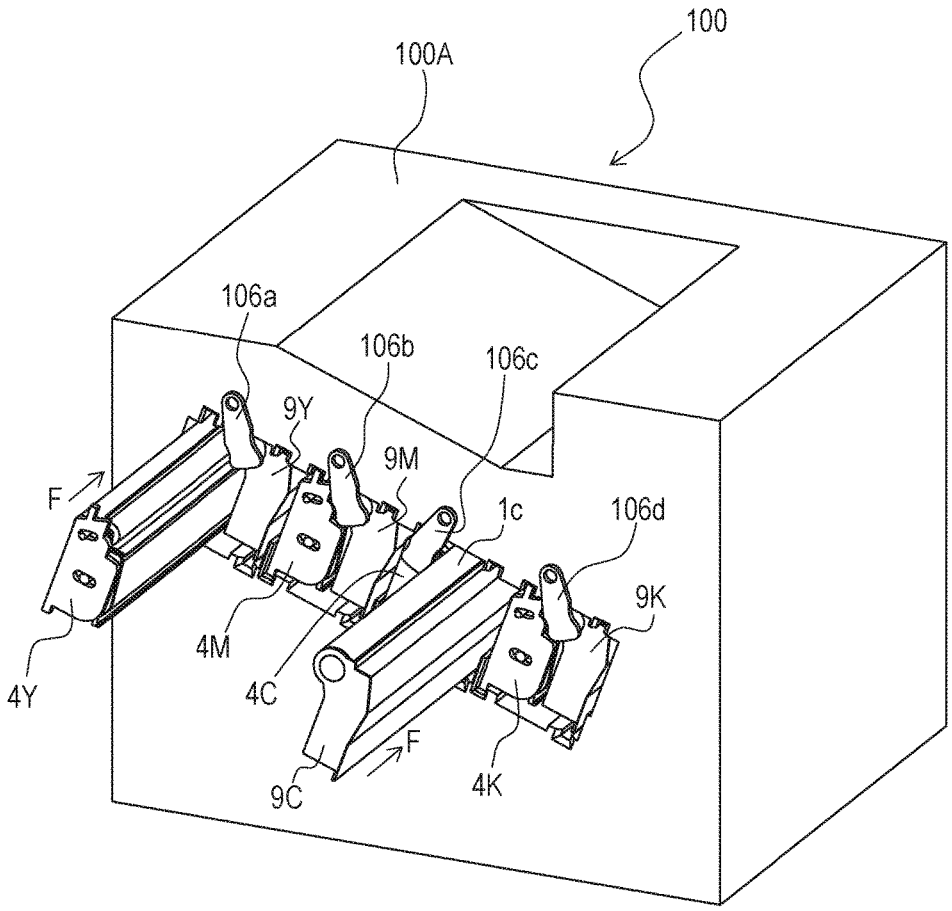
FIG. 9 is an explanatory diagram of mounting a developing device according to an embodiment of the present invention and a drum cartridge to an apparatus main body.

As illustrated in FIG. 9, the photosensitive drum cartridges 9 are mounted/detached to/from the mounting opening portions 101, with the axial direction of the photosensitive drums 1 being the mounting/detaching direction. The developing cartridges 4 also are mounted/detached to/from the mounting opening portions 101, with the axial direction of the developing rollers 25 being the mounting/detaching direction. That is to say, the photosensitive drum cartridges 9 and developing cartridges 4 are inserted from the front side toward the rear side. Hereinafter, this direction will be referred to as "insertion direction F".

Figure 8:
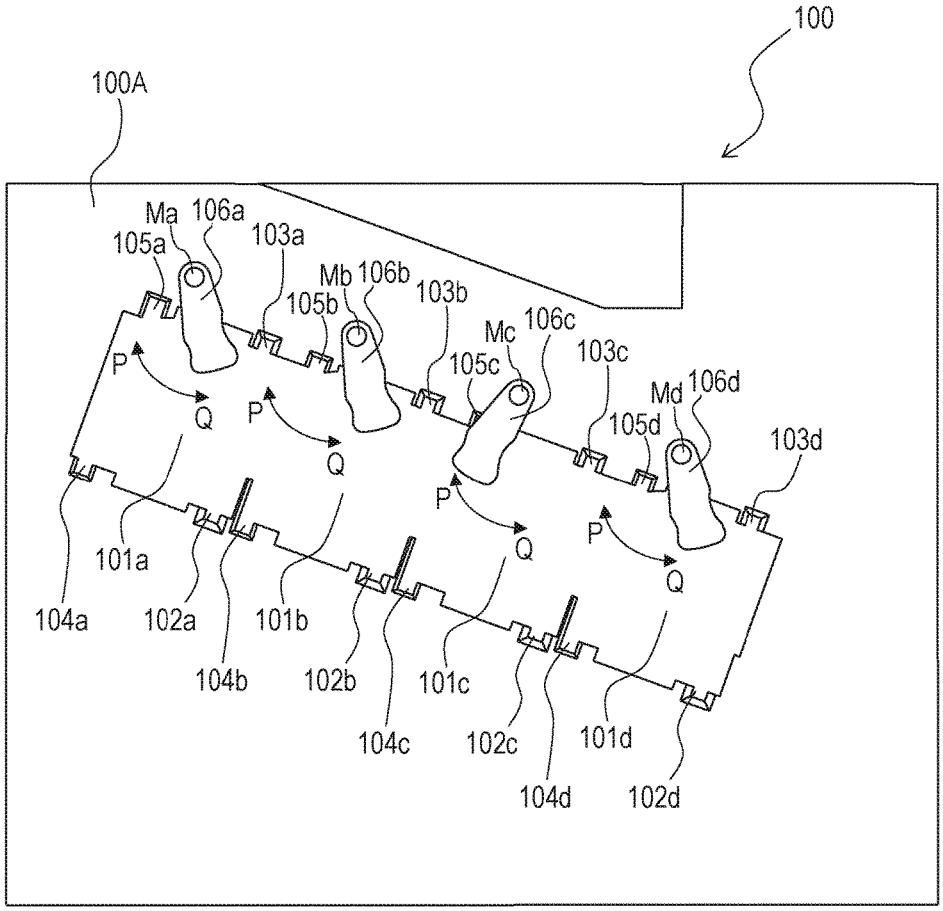
FIG. 8 is an explanatory diagram of a mounting portion between a developing device and a drum cartridge in an apparatus main body of an image forming apparatus according to an embodiment of the present invention.

Upper guide portions 103 (103*a*, 103*b*, 103*c*, 103*d*) that are first apparatus body guides for the drum cartridges are provided at the upper side of the apparatus main body 100A, as illustrated in FIG. 8. Lower guide portions 102 (102*a*, 102*b*, 102*c*, 102*d*) that are second apparatus body guides for the drum cartridges are provided at the lower side of the apparatus main body 100A. The upper guide portions 103 and lower guide portions 102 are guide shapes each following the insertion direction F of the photosensitive drum cartridges 9.

Upper guide portions 105 (105*a*, 105*b*, 105*c*, 105*d*) that are third apparatus body guides for the developing cartridges are provided at the upper side of the apparatus main body 100A. Lower guide portions 104 (104*a*, 104*b*, 104*c*, 104*d*) that are fourth apparatus body guides for the developing cartridges are provided at the lower side of the apparatus main body 100A. The upper guide portions 105 and lower guide portions 104 are guide shapes each following the insertion direction F of the developing cartridges 4.

Locking Lever 106

The apparatus main body 100A is provided with locking levers (regulating members) 106 (106*a*, 106*b*, 106*c*, 106*d*) having the pressing portions 1061 (FIG. 1) coming into contact with the biased members 13*b* (FIGS. 1 and 6) of the developing cartridges 4, as illustrated in FIG. 8. The locking levers 106 (106*a*, 106*b*, 106*c*, 106*d*) pivot on pivot centers M (Ma, Mb, Mc, Md) as illustrated in FIG. 8. That is to say, the locking levers 106 are configured so as to be movable in a first direction (P direction) and a second direction (Q direction) that is the opposite direction from the first direction. The locking levers 106 thus are capable of moving independently from the cartridge biasing member 80. Accordingly, the locking levers 106 can move when the cartridge biasing member 80 is stationary.

When a user mounts/detaches a photosensitive drum cartridge 9 to/from the apparatus main body 100A, the locking lever 106 is pivoted in the P direction, and when the user mounts/detaches a developing cartridge 4 to/from the apparatus main body 100A, the locking lever 106 is pivoted in the Q direction.

Insertion (mounting) of a photosensitive drum cartridge 9 and developing cartridge 4 to the apparatus will be described in more detail with reference to FIGS. 8 and 9. When inserting a developing cartridge 4, the locking lever 106 is moved toward the photosensitive drum cartridge 9 side (in the Q direction in FIG. 8), which is a developing cartridge 4 mounting/detaching position (first position) such as illustrated in FIG. 9. This allows mounting/detaching of the developing cartridge 4 to/from the apparatus main body 100A. When the locking lever 106 is at the developing cartridge mounting/detaching position, the photosensitive drum cartridge 9 cannot be mounted/detached due to interference of the locking lever 106 (mounting/detaching is restricted). That is to say, the developing cartridge mounting/detaching position also is a mounting/detaching restriction position that restricts mounting/detaching of the photosensitive drum cartridge 9. When the locking lever 106 is moved in the Q direction, the cartridge biasing member 80 is stationary and does not move.

When inserting a photosensitive drum cartridge 9, the photosensitive drum cartridge 9 is placed on the lower guide portion 102 and upper guide portion 103 at the front side in the mounting direction. The locking lever 106 is moved toward the developing cartridge 4 side (in the P direction in FIG. 8), which is a drum cartridge mounting/detaching position (second position) such as illustrated in FIG. 1. This allows mounting/detaching of the photosensitive drum cartridge 9 to/from the apparatus main body 100A. When the locking lever 106 is at the drum cartridge mounting/detaching position, the developing cartridge 4 cannot be mounted/detached due to interference of the locking lever 106 (mounting/detaching is restricted). That is to say, the drum cartridge mounting/detaching position is a mounting/detaching allowing position that allows mounting/detaching of the photosensitive drum cartridge 9. When the locking lever 106 is moved in the P direction, the cartridge biasing member 80 is stationary and does not move.

The photosensitive drum cartridge 9 is then inserted into the apparatus main body 100A by moving in the insertion direction F following the upper guide portion 103 and lower guide portion 102 for the drum cartridge.

Now, the developing device has the biased member 13*b* as illustrated in FIG. 1, and the locking lever 106 has the pressing portion 1061. Accordingly, moving the locking lever 106 in the P direction when inserting the photosensitive drum cartridge 9 causes the pressing portion 1061 of the locking lever 106 to press the biased member 13*b*. Thus, the developing unit 39 in the developing cartridge 4 can be distanced from the photosensitive drum 1, so the photosensitive drum cartridge 9 can be inserted/extracted without damaging the photosensitive drum 1. When the biased member 13*b* is being pressed by the pressing portion 1061 of the locking lever 106 and the developing unit 39 is at a position away from the photosensitive drum 1, the developing roller 25 is at a second separated position. The second separated position is a position where the developing roller 25 is further away from the photosensitive drum 1 than the first separated position.

The apparatus main body 100A has a door, omitted from illustration, that opens and closes the mounting opening portion 101. When the door is opened, the cartridge biasing member 80 always moves in the separating direction B, so the biased member 31*e* is pressed and moves to the first separated position. When a photosensitive drum cartridge 9 is to be inserted to or extracted from the apparatus main body 100A, the user moves the locking lever 106 in the P direction from this state. Thus, the developing roller 25 further moves from the first separated position to the second separated position.

On the other hand, in a case of inserting a developing cartridge 4 into the apparatus main body 100A, the developing cartridge 4 is placed on the upper guide portion 105 and lower guide portion 104 at the front side in the mounting direction. The locking lever 106 is moved to the photosensitive drum cartridge 9 side (Q direction). The developing cartridge 4 is then inserted into the apparatus main body 100A by moving the developing cartridge 4 in the insertion direction F following the upper guide portion 105 and lower guide portion 104.

An alternative configuration, where the developing roller 25 is moved from the contact position through the first separated position to the second separated position by biasing of the biased member 31*e* by the cartridge biasing member 80, will be considered. In this case, the amount of movement of the cartridge biasing member 80 needs to be greater, and a mechanism is necessary to stop the developing roller 25 at the three positions of the contact position, the first separated position, and the second separated position. This makes the configuration for moving the cartridge biasing member 80 larger and more complex. However, by moving the developing roller 25 from the first separated position to the second separated position using the locking lever 106, which is a different member from the cartridge biasing member 80, increased complexity, size, and so forth, of the cartridge biasing member 80 can be suppressed.

Now, providing the photosensitive drum cartridge 9 with a second biased member W, corresponding to the biased member 13*b* of the developing cartridge 4, as illustrated in FIG. 1, enables the pressing portion 1061 of the locking lever 106 to press the second biased member W by the user moving the locking lever 106 in the Q direction. Accordingly, the photosensitive drum 1 can be distanced from the developing unit 39 of the developing cartridge 4, and the developing cartridge 4 can be inserted/extracted without damaging the photosensitive drum 1.

Modifications

Although a preferred embodiment of the present invention has been described, the present invention is not restricted to this embodiment, and various modifications and alterations may be made within the scope of the essence thereof.

First Modification

An arrangement has been described in the above embodiment where the biased member (pressed member) 13*b* and the second biased member (second pressed member) W are respectively provided at positions on the developing cartridge 4 and photosensitive drum cartridge 9 that is the leading edge when mounting to the apparatus main body 100A. However, this is not restrictive, and the biased member (pressed member) 13*b* and the second biased member (second pressed member) W may be provided at a position further rearwards from the leading edge side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-089066 filed Apr. 27, 2016 and No. 2017-034505 filed Feb. 27, 2017, which are hereby incorporated by reference herein in their entirety.

What is claimed is:

1. An image forming apparatus comprising:

an apparatus main body to which a cartridge that has a first rotating member is detachably mountable;

a first pressing member configured to press a unit that has a second rotating member that can come into contact with the first rotating member, and a supporting member rotatably supporting the second rotating member; and a second pressing member configured to press the supporting member, wherein the first pressing member moves the second rotating member from a contact position where the second rotating member is in contact with the first rotating member to a separated position where the second rotating member is separated from the first rotating member, by moving while pressing the supporting member, wherein the second pressing member is capable of moving between a mounting/detaching restriction position where mounting/detaching of the cartridge to the apparatus main body is restricted, and a mounting/detaching allowing position where mounting/detaching of the cartridge to the apparatus main body is allowed, and wherein the second pressing member moves the unit to a position distanced from the first rotating member by moving from the mounting/detaching restriction position to the mounting/detaching allowing position while pressing the supporting member, so the cartridge is in an extractable state from the apparatus main body.

2. The image forming apparatus according to claim 1, wherein, when the second pressing member is at the mounting/detaching restriction position, the unit is mountable/detachable to/from the apparatus main body, and when the second pressing member is at the mounting/detaching allowing position, the mounting/detaching of the unit to/from the apparatus main body is restricted.

3. The image forming apparatus according to claim 2, wherein the first rotating member is moved to a position distanced from the unit by the second pressing member moving from the mounting/detaching allowing position to the mounting/detaching restriction position.

4. The image forming apparatus according to claim 1, wherein the second pressing member is provided only at one end of the apparatus main body with regard to a rotational axis direction of the second rotating member.

5. The image forming apparatus according to claim 1, wherein the first rotating member is a photosensitive member, and the second rotating member is a developing roller that bears developer to visualize a latent image formed on the photosensitive member.

6. The image forming apparatus according to claim 1, further including the unit comprising:

a first frame member;

a second frame member configured to be rotated as to the first frame member via a supporting shaft;

the second rotating member is configured to be rotatably supported by the second frame member;

a first force receiving portion provided on the second frame member, the first force receiving portion being configured to receive force rotating the second frame member in a first direction;

a second force receiving portion provided on the second frame member, the second force receiving portion being configured to receive force rotating the second frame member in the first direction, wherein the second force receiving portion is provided on a projection protruding from one end portion with regard to the rotational axis direction of the rotating member, and the second force receiving portion is disposed on the opposite side of the supporting shaft from the first force receiving portion.

7. The image forming apparatus according to claim 6, wherein the first frame member is disposed closer to one end portion of the second frame member as compared to an other end portion, with regard to the rotational axis direction, and a hole is provided in the first frame member to avoid interference with the projection.

8. The image forming apparatus according to claim 6, wherein the second rotating member is a developing roller that bears developer.

9. The image forming apparatus according to claim 6, wherein the supporting shaft is a boss provided to the second frame member.

10. The image forming apparatus according to claim 6, further comprising:

a driving force receiving portion disposed at the other end portion of the second frame member with regard to the rotational axis direction, where driving force to rotate the rotating member is input.

11. The image forming apparatus according to claim 6, wherein the unit is another cartridge that has the second rotating member and that is detachably mountable to the apparatus main body.

12. An image forming apparatus comprising:

an apparatus main body to which a cartridge that has a first rotating member is detachably mountable;

a first pressing member configured to press a unit that has a second rotating member that can come into contact with the first rotating member, and a supporting member rotatably supporting the second rotating member;

and a second pressing member configured to press the supporting member, wherein the first pressing member moves the second rotating member from a contact position where the second rotating member is in contact with the first rotating member to a first separated position where the second rotating member is separated from the first rotating member, by moving while pressing the supporting member, wherein the second pressing member is capable of moving when the first pressing member is stationary, and wherein the second pressing member moves the supporting member to the second separated position where the second rotating member is more distanced from the first rotating member as compared to when the second rotating member is at the first separated position, by moving while pressing the supporting member, and when at the second separated position, the cartridge can be mounted/detached to/from the apparatus main body.

13. The image forming apparatus according to claim 12, wherein the second pressing member is capable of moving between a mounting/detaching restriction position where mounting/detaching of the cartridge to/from the apparatus main body is restricted, and a mounting/detaching allowing position where mounting/detaching of the cartridge to/from the apparatus main body is allowed, and in a case where the second pressing member is at the mounting/detaching allowing position, the supporting member is at the second separated position.

14. The image forming apparatus according to claim 12, wherein the second pressing member is provided only at one end of the apparatus main body with regard to a rotational axis direction of the second rotating member.

15. The image forming apparatus according to claim 12, wherein the first rotating member is a photosensitive member, and the second rotating member is a developing roller that bears developer to visualize a latent image formed on the photosensitive member.

* * * * *